US006727416B1

(12) United States Patent
Vale

(10) Patent No.: US 6,727,416 B1
(45) Date of Patent: Apr. 27, 2004

(54) PIANO HAMMER ADJUSTMENT APPARATUS AND METHOD FOR USING SAME

(76) Inventor: Raymond J. Vale, 6006 Forest Ledge, San Antonio, TX (US) 78240

( * ) Notice: Subject to any disclaimer, the term of this patent is extended or adjusted under 35 U.S.C. 154(b) by 0 days.

(21) Appl. No.: 10/419,420

(22) Filed: Apr. 21, 2003

(51) Int. Cl.[7] ..... G10G 7/00
(52) U.S. Cl. ..... 84/459; 84/458
(58) Field of Search ..... 84/459, 454, 458, 84/440, 432, 433, 434, 436

(56) References Cited

U.S. PATENT DOCUMENTS 3,696,699 A * 10/1972 Tachida ..... 84/251
4,686,879 A * 8/1987 Ito et al. ..... 84/440
4,896,577 A * 1/1990 Trivelas et al. ..... 84/240
5,565,636 A * 10/1996 Sugiyama ..... 84/171
6,087,574 A * 7/2000 Kitashima et al. ..... 84/423 R
6,509,517 B1 * 1/2003 Wroblewski ..... 84/216

* cited by examiner

*Primary Examiner*—Kimberly Lockett
(74) *Attorney, Agent, or Firm*—Cline H. White; Jackson Walker LLP

(57) ABSTRACT

The present invention is an apparatus tuning and adjusting pianos. It maybe attached to the existing hammer shank and simulates a piano hammer. The present invention's dimensions and angles are adjustable. As the present invention is moved into strike position on the hammer shank, the multiple adjustments allow the piano technician to measure the characteristics needed to achieve the optimal strike point of the string. These measurements can then be used to correctly install the piano hammer and tune the piano.

11 Claims, 6 Drawing Sheets

PIANO HAMMER ADJUSTMENT APPARATUS AND METHOD FOR USING SAME

BACKGROUND OF THE INVENTION

Field of the Invention

Applicant's invention relates to a device for adjusting the hammers in upright pianos and a method for using same. More particularly, it relates to a device and method to adjust the rake, hammer bore length, and shank length.

Background Information

Conventional upright pianos, including such variations as spinets, consoles, studios, and grand uprights, have the piano action located vertically inside the piano case and a few inches away from the piano strings. The strings are installed in such a way that, along the bridging, the strings rise and slope to the rear and wrap on the piano harp hitch pin which is known as the rear string bearing. Likewise, the slope in front of the bridge, called the front bearing, and the string terminates at the agraffs. The piano hammer is attached to hammer shank which connects into a hammer butt which is attached to the action by a flange. When a key is pressed, the hammer rotates along an arc until it contacts a piano string.

Ideally, the hammer should contact the string directly on its crown and at a 90% angle, or perpendicular to the string. However, because the string is not exactly vertical and the hammer is traveling along an arc, adjusting the hammer to make the ideal hit is a difficult procedure. Additionally, the hammer should strike the string one-eighth of an inch from the center of the front bearing, making the length of the hammer shank an important measurement as well. Further increasing the difficulty, each hammer in the piano has a different shank length and travels along a different arc necessitating that each hammer be individually measured and adjusted.

If the hammer does not contact the string at 90%, one-eighth of an inch below the front bearing, and on the hammer crown, the hammer strike will not produce the piano's best possible sound. If the hammer shoulders contact the string or if hammer contacts at a different angle or at a different point, the piano will not produce a brilliant and clean sound. However, if the hammer is adjusted correctly, the piano will produce the best possible sound, making sustained music that has clarity, power, and projection.

The parameters of string deflection and piano mechanism distance to the string, coupled with the fact that the hammer center crown must strike the string at a pre-determined point below the agraff makes the process of hammer installation and adjustment a challenging project. The piano technician must find the correct bore distance, rake, and shank length to achieve a 90% hammer strike at a pre-determined point along the string. Unfortunately, the correct tolerances vary from piano to piano, even within the same brands.

Generally, piano technicians will remove the old hammer with the shank and butt and try to duplicate the existing hammer dimensions. Unfortunately, it is difficult to replicate an old hammer, in part due to wear and replication problems, and it also assumes that the old hammer was correctly adjustment, which may not be correct.

Thus, there is a need for a device and method for correctly measuring the bore distance, rake, and shank length of pianos.

SUMMARY OF THE INVENTION

The present invention measures the bore distance, rake, and shank length of an upright piano hammer in order to optimize the strike point and position of the piano hammer. The method of the present invention involves the usage of the device in order to correctly measure and install piano hammers in a piano in order to optimize the strike-pointed position of the hammer and thereby obtain the piano's optimal sound quality.

The present invention provides a novel apparatus that will accurately measure the three most important elements of piano hammer installation: (1) bore length, (2) rake, and (3) piano shank length.

The present invention further provides:

a. A single device that is compatible with many and various upright pianos;

b. Adjustments that can be made inside a specific piano to account for that individual piano's characteristics; and c. A method to precisely measure those angles and distances unique to the subject piano so that piano hammers can be correctly and optimally installed.

In order to solve the difficulties presented in attempting to obtain these features, an apparatus has been developed which is attached to the existing hammer shank and simulates a piano hammer. However, the present invention's dimensions and angles are adjustable so that, as it is moved into strike position, it can be adjusted to meet the optimal strike point of the piano string. The multiple adjustments allow the piano technician to measure the characteristics needed for optimal adjustment of the installed piano hammer.

The method of use of the present invention involves determining the optimal measurements and angles of the hammer to strike the piano string at its optimal strike point.

Specifically, the present invention provides for a device and method to achieve a 90% perpendicular angle strike on the piano string by the piano hammer's center crown at a desired point along the piano string, thus, obtaining the optimal clarity, power, projection, and sustaining quality of sound of that piano.

DETAILED DESCRIPTION OF THE PREFERRED EMBODIMENT

Figure 1:
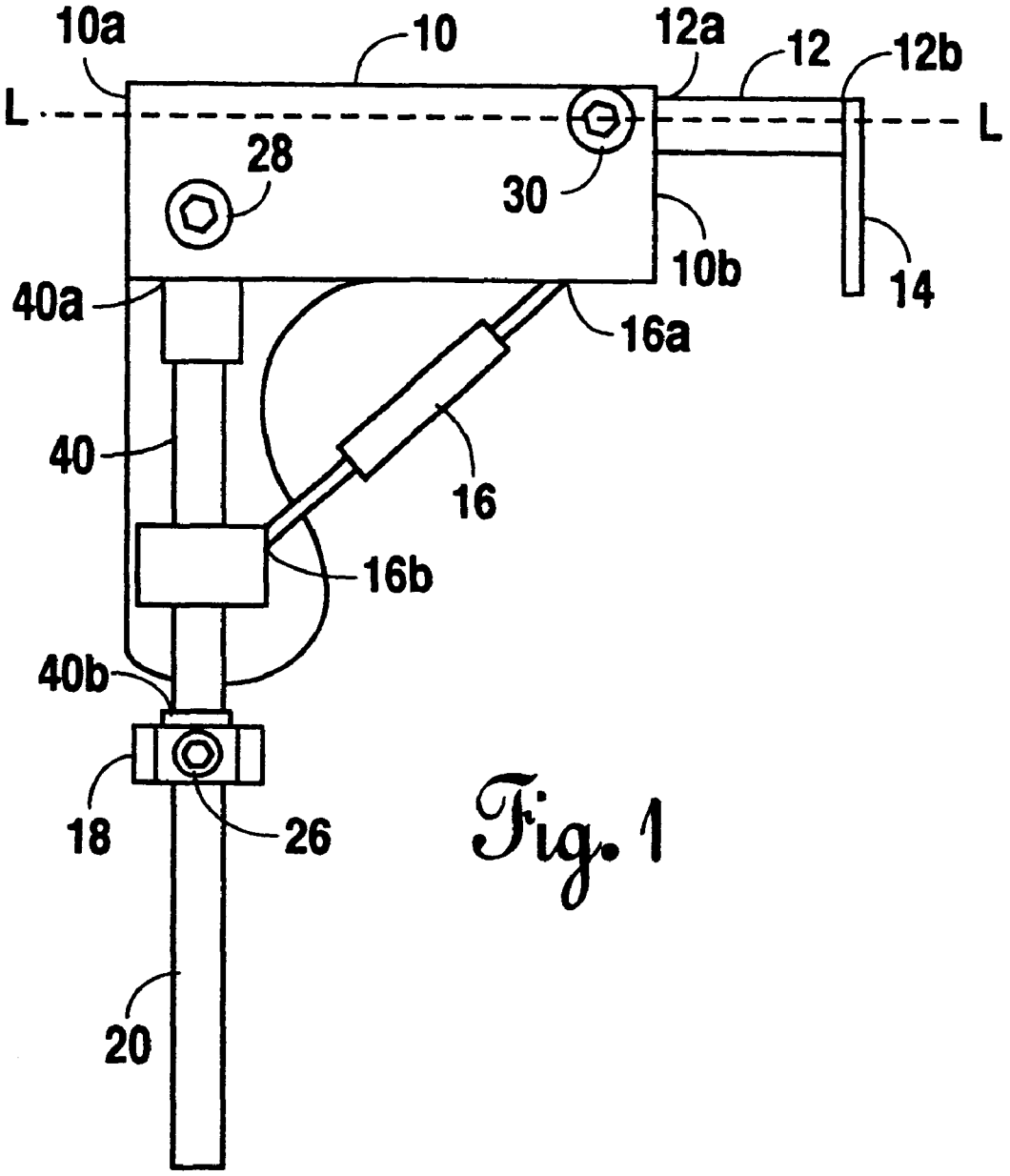
FIG. 1 is a side view of the present invention.

Referring to the figures, FIG. 1 shows a side view of the hammer tool (2). This figure shows the hammer tool body (10) with a first end (10*a*) and a second end (10*b*). A shank (40) also has a shank first end (40*a*) and a shank second end (40*b*). The shank first end (40*a*) is pivotally attached to the hammer tool body first end (10*a*). This allows the hammer tool (2) to change its general shape, from the hammer tool body (10) being perpendicular to the shank (40) and lesser or greater angles being created by the hammer tool body (10) in relation to the shank (40). The hammer tool body (10) has its longitudinal axis (L—L) which can be used to determine the angle of said hammer tool body (10) in relationship to the shank (40). Connected to the hammer tool body (10) distally from the hammer tool body first end (10*a*) is a rake adjustment member (16). The rake adjustment member (16) has two ends, a first end (16*a*) and a second end (16*b*). The rake adjustment member first end (16*a*) is attached to the hammer tool body (10) distally from the hammer tool body first end (10*a*) and the rake adjustment member second end (16*b*) is attached to the shank (40) distally from the shank first end (40*a*). The hammer tool (2) can be adjusted by varying the length of the shank adjustment member (16) so that the angle of the longitudinal axis (L—L) of the hammer tool body (10), in relation to the shank (40), is changed. As the rake adjustment member (16) is lengthened, the resulting angle created by the longitudinal axis (L—L) of the hammer body (10) relative to the shank (40) is increased. Conversely, when the rake adjustment member's (16) length is shortened, the resulting angle between the longitudinal axis (L—L) of the hammer tool body (10) relative to the shank (40) is decreased. Slidably attached to the hammer tool body second end (10*b*) is the first end (12*a*) of an extender (12). The extender second end (12*b*) can is perpendicularly attached to an extender shoe (14). Also shown is a shank extension (20) which is slidably attachable to the shank (40). The shank extension (20) has a shank extension collar (18) that is sized to accept, or be accepted by, the shank second end (40*b*). Also shown in this figure is the shank extension lock member (26) which serves to maintain the otherwise slidable shank extension (20) at a fixed position along the shank (40). Likewise, the angle lock member (28) can fix the otherwise rotatable shank (40) at a set angle in relation to the hammer tool body (10). Finally, the extender lock member (30) serves to maintain the otherwise slidable extender (12) at a fixed position from the hammer tool body (10).

Figure 2:
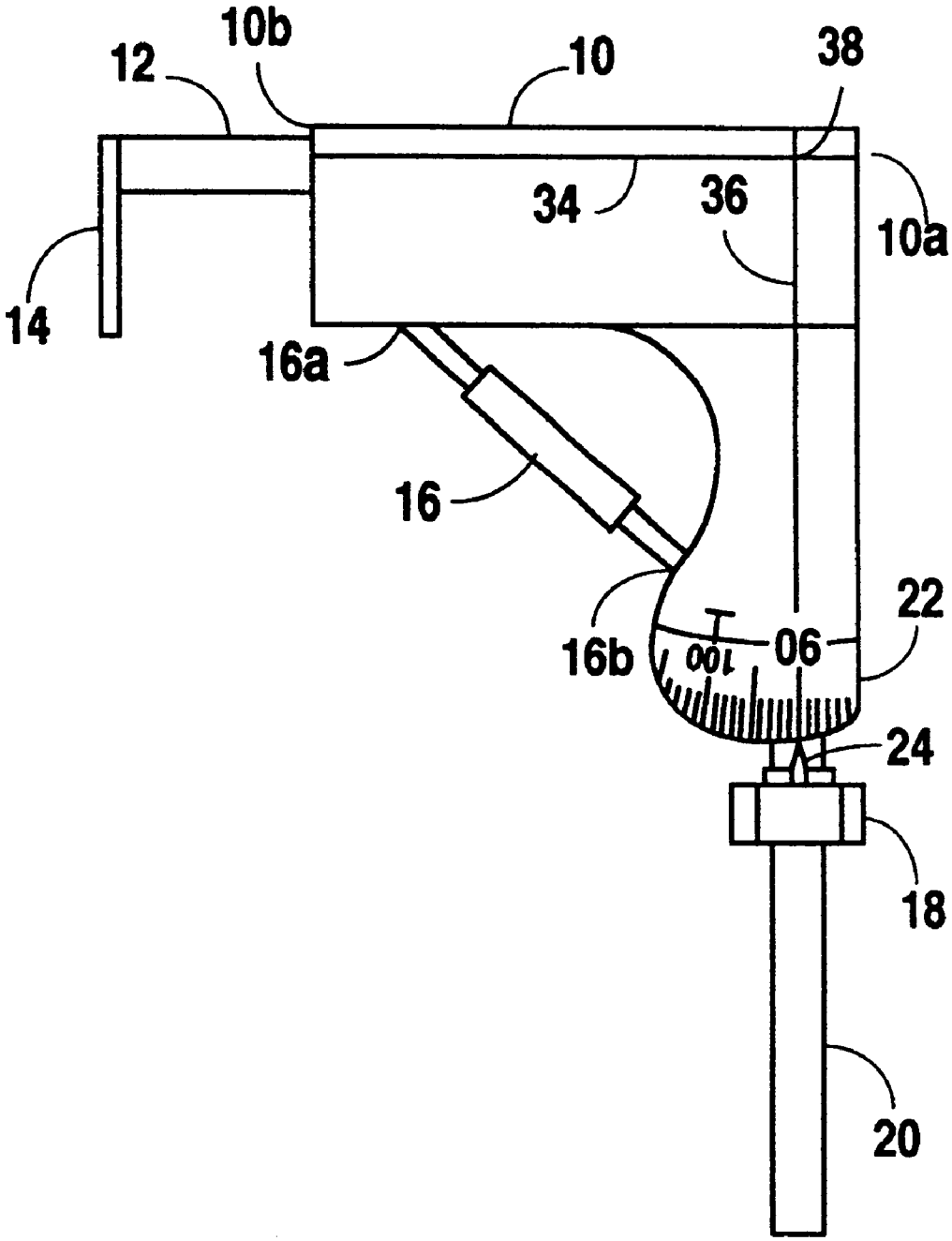
FIG. 2 is a second side view of the present invention.

FIG. 2 is a second side view of the hammer tool (2). In particular, it shows the rake measurement scale (22). In this embodiment of the hammer tool (2), the rake measurement scale (22) is part of the hammer tool body (10). However, the function of the rake measurement scale (22) is to measure the angle of the shank (40) in relation to the hammer tool body (10), and there are many ways in which the rake measurement scale (22) can be configured. In this embodiment, the rake measurement scale (22) has a measured scale in units of degrees relative to the hammer tool body (10). It is read using the rake measurement indicator (24) that is attached to the shank (40). As the rake adjustment member (16) is shortened or lengthened and the shank (40) rotates relative to the hammer tool body (10), the rake measurement indicator (24) moves relative to the rake measurement scale (22) and the angle of the shank (40) in relation to the hammer tool body (10) can be determined.

Figure 3:
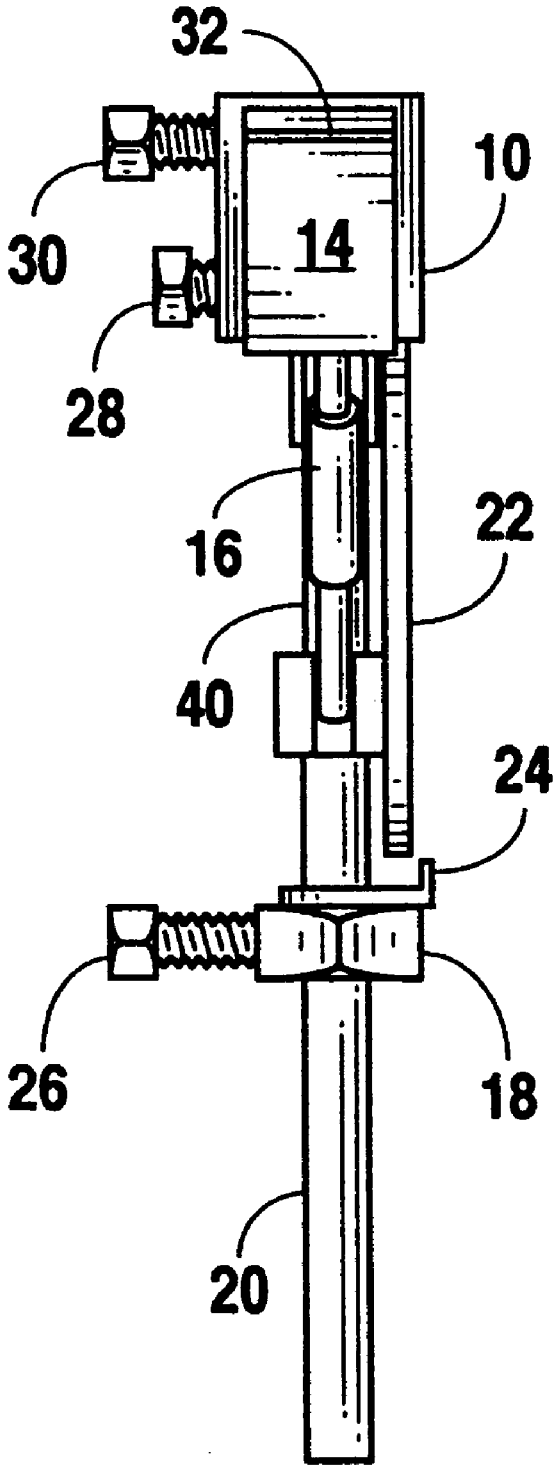
FIG. 3 is a front view of the present invention.

FIG. 3 is a front view of the hammer (202). It shows the extender shoe (14) which has a hammer strikeline (32). The hammer strikeline (32) indicates the point at which, when an actual hammer (100) is installed, will contact the string (102). Extending below the extender shoe (14) is the rake adjustment member (16). It extends at an angle backward connecting to the shank (40). Also seen in this figure is the shank extension (20) which is held in place on the shank (40) by the shank extension collar (18) and the shank extension lock member (26). Also viewable are the angle lock member (28) and the extender lock member (30).

Figure 4:
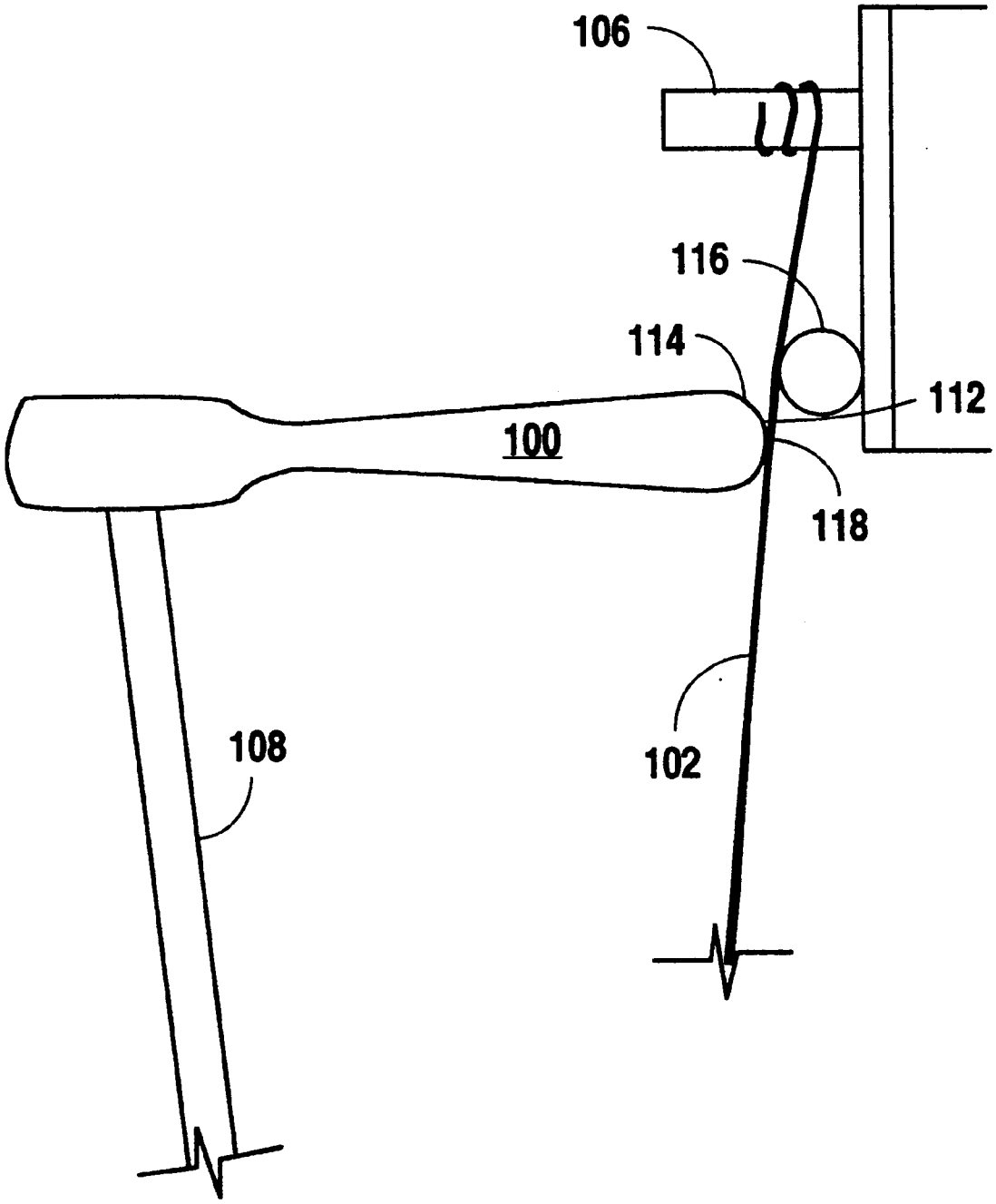
FIG. 4 is a side view of a piano hammer and string.

FIG. 4 is a general diagram illustrating the configuration of the piano action (104), hammer (100), and strings (102). The strings (102) are attached at the agraff(106) and tightened across the front bearing (116). The hammer (100) is attached to the hammer shank (108) which is in turn attached at its opposite end to the hammer butt (110). FIG. 4 is a close-up of the hammer (100), hammer shank (108), and string (102) which is pulled across the front bearing (116) and the held by the agraff(106). This figure more clearly shows how the hammer (100) travels in an arc to strike the string (102). As the hammer butt (110) rotates, it swings the hammer (100) forward along the arc towards the string (102). As will be noted from this figure, the hammer (100) does not rest perpendicularly to the string (102), but rather is at an angle that allows the forward motion to bring the hammer (100) into contact with the string (102) perpendicularly. FIG. 4 further illustrates the contact of the hammer (100) with the string (102). The angle of impact and the point of impact of the hammer (100) is extremely important. This figure shows that the hammer (100) is striking the string (102) at a perpendicular angle. Further, the hammer (100) preferably strikes the string (102) at a point slightly below the front bearing (116). The string (102) is struck by the hammer crown (112), which is shown in contact with the string (102) in this figure.

Figure 5A:
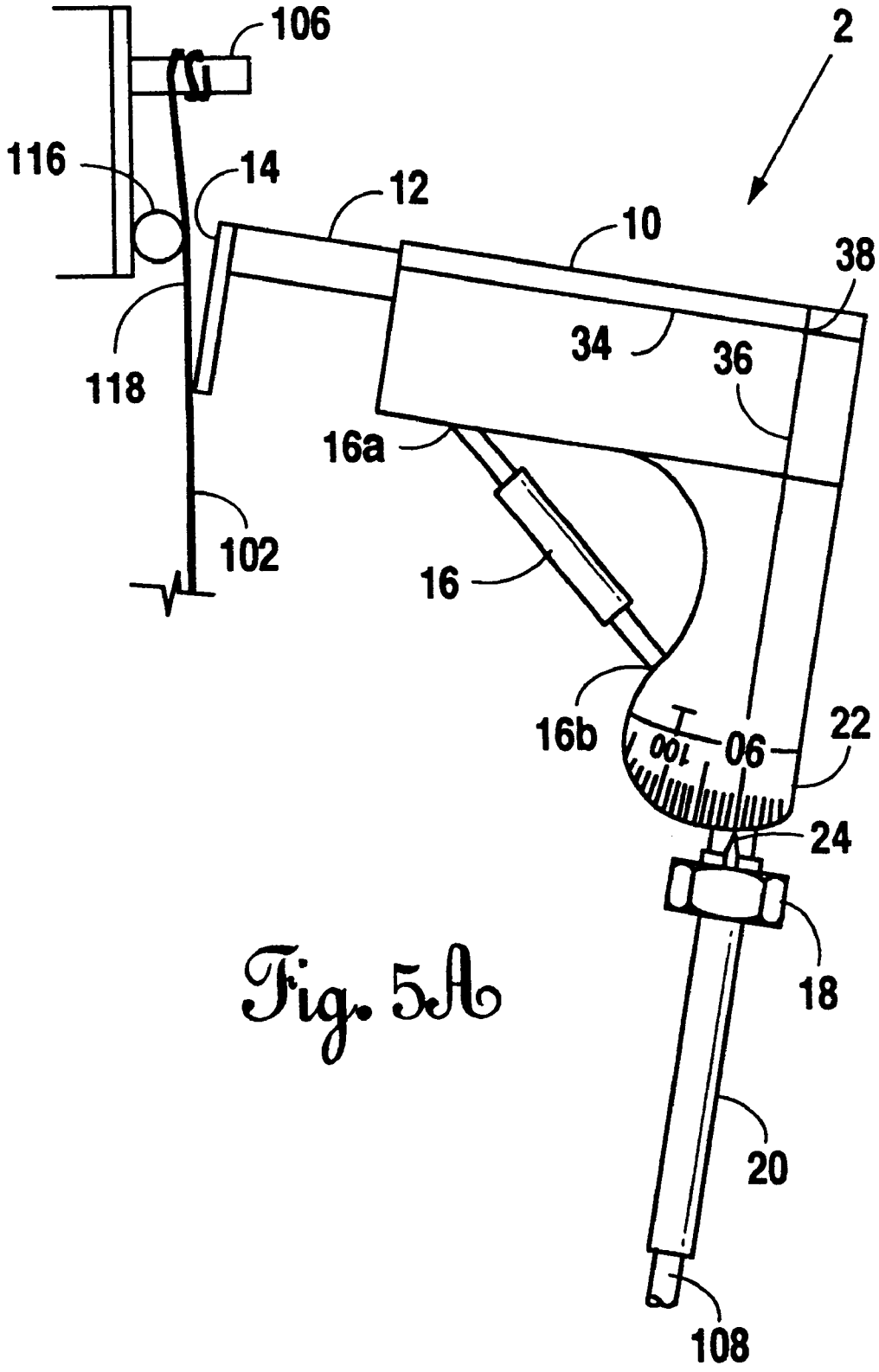
FIG. 5*a* is a first side view of the present invention contacting a piano string.
Figure 5B:
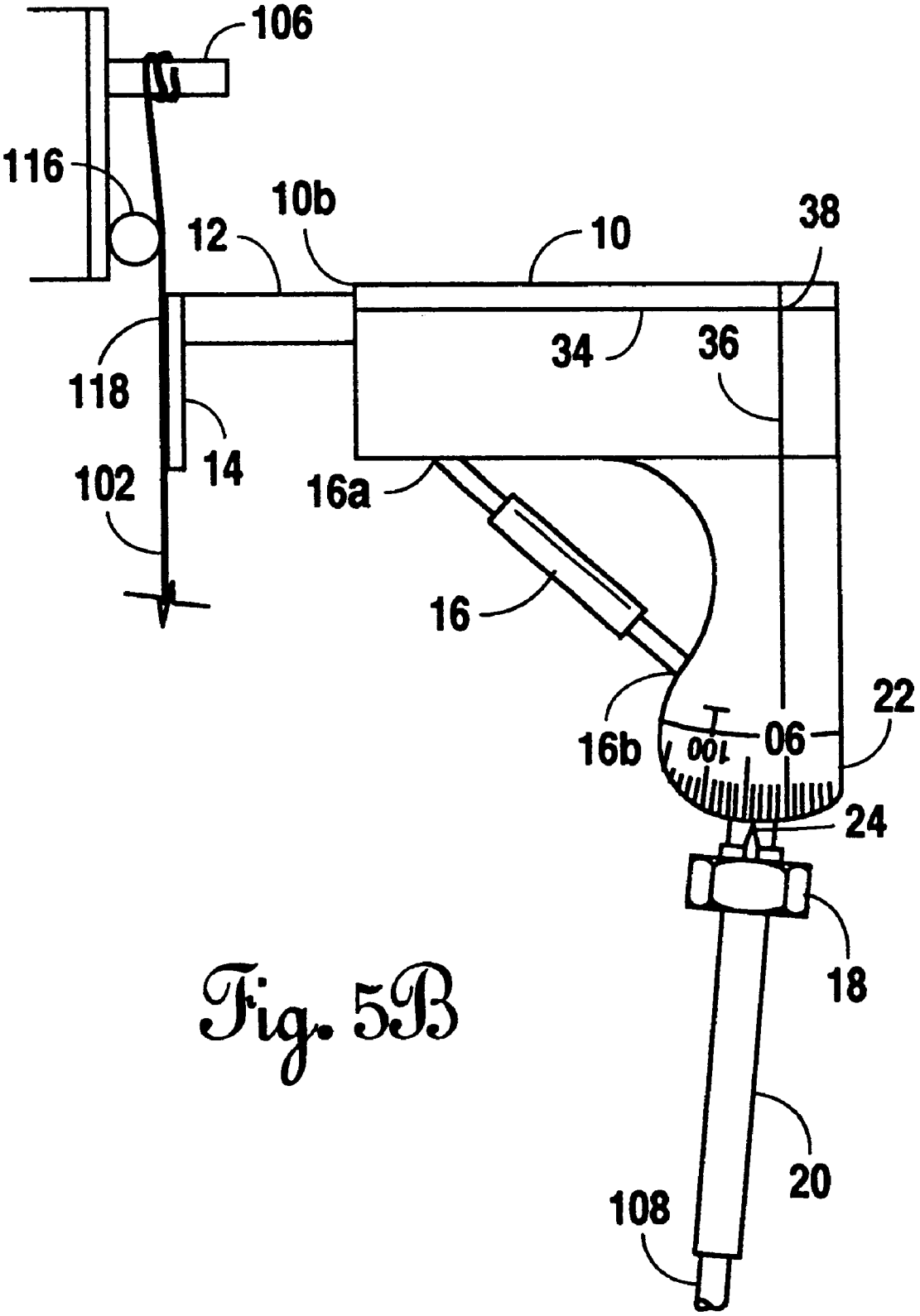
FIG. 5*b* is a second side view of the present invention contacting a piano string.

FIGS. 5*a* and 5*b* illustrate the method of using the hammer tool (2). In these figures, the hammer tool (2) has been attached to the hammer butt (110) by sliding the shank extension (20) and the shank (40) over the hammer shank (108). The shank extension lock member (26) fixes the hammer tool (2) in place on the hammer shank (108). The hammer tool body (10) is shown held in an initial angle by the rake adjustment member (16). Extending from the hammer tool body (10) is the extender (12) and the extender shoe (14), which is held in place by the extender lock member (30).

FIG. 5*a* is a close-up side view of the hammer tool (2) after it has been moved into contact with the string (102). This figure shows the hammer tool (2) prior to adjustment where the extender shoe (14) is only partially contacting the string (102). In order to adjust the hammer tool (2) and obtain a measurement angle, the length of the rake adjustment member (16) is adjusted to change the angle of the hammer tool body (10) and consequently the extender shoe (14). By modifying the length of the rake adjustment member (16), the extender shoe (14) can be adjusted until it comes in full contact with the string (102). In order to further obtain the desired measurements, the extender (12) is slid outwardly or inwardly from the hammer tool body (10). Once the correct length is determined, the extender shoe lock member can be employed in order to fix the length of the extender (12). The final measurement can be obtained by adjusting the shank (not shown) such that the hammer strikeline (32) contacts the string (102) slightly below the front bearing (116).

FIG. 5*b* shows the hammer tool (2) having been adjusted such that the extender shoe (14) is fully in contact with the string (102). The hammer strikeline (32) is contacting the desired string strike point (118) slightly below the front bearing (116). This figure further shows the adjusted extender (12) as well as the rake adjustment member (16) which has been adjusted to change the angle of the shank (40) with the hammer tool body (10). Once the adjusted hammer tool (2) has been removed from the piano (not shown). The correct angle for the hammer (100) is obtained by reading the rake measurement scale (22) with the rake measurement indicator (24).

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. An apparatus for adjusting hammers on hammer shanks in upright pianos comprising:

a hammer tool body having a first end and a second end, and a longitudinal axis;

a shank having a first end and a second end, said shank first end pivotally attached to said hammer tool body first end; and a rake adjustment member having a first end and a second end, said rake adjustment member first end attached to said hammer tool body distal from said hammer tool body first end, said rake adjustment member second end attached to said shank distal from said shank first end, and said rake adjustment member adjusting the angle of said longitudinal axis of said hammer tool body in relation to said shank.

2. The apparatus of claim 1, further comprising an extender having a first end and a second end, said extender first end slidably attached to said hammer tool body second end.

3. The apparatus of claim 2, further comprising an extender shoe attached perpendicularly to said extender second end.

4. The apparatus of claim 1, further comprising a rake measurement scale attached to said hammer tool body capable of measuring said angular adjustment of said longitudinal axis of said hammer tool body in relation to said shank.

5. The apparatus of claim 1, wherein said shank second end has an aperture sized to fit about said hammer shank.

6. The apparatus of claim 1, further comprising a shank extension slidably attached to said shank second end, and said shank extension having an aperture sized to fit about said hammer shank.

7. An apparatus for adjusting hammers on hammer shanks in upright pianos comprising:

a hammer tool body having a first end and a second end, and a longitudinal axis;

a shank having a first end and a second end, said shank first end pivotally attached to said hammer tool body first end;

an extender having a first end and a second end, said extender first end slidably attached to said hammer tool body second end;

a rake adjustment member having a first end and a second end, said rake adjustment member first end attached to said hammer tool body distal from said hammer tool body first end, said rake adjustment member second end attached to said shank distal from said shank first end, and said rake adjustment member adjusting the angle of said longitudinal axis of said hammer tool body in relation to said shank; and a rake measurement scale attached to said hammer tool body capable of measuring said angular adjustment of said longitudinal axis of said hammer tool body in relation to said shank.

8. The apparatus of claim 7, further comprising an extender shoe attached perpendicularly to said extender second end.

9. The apparatus of claim 7, wherein said shank second end has an aperture sized to fit about said hammer shank.

10. The apparatus of claim 7, further comprising a shank extension slidably attached to said shank second end, and said shank extension having an aperture sized to fit about said hammer shank.

11. An apparatus for adjusting hammers on hammer shanks in upright pianos comprising:

a hammer tool body having a first end and a second end, and a longitudinal axis;

a shank having a first end and a second end, said shank first end pivotally attached to said hammer tool body first end; and a rake adjustment member having a first end and a second end, said rake adjustment member first end attached to said hammer tool body distal from said hammer tool body first end, said rake adjustment member second end attached to said shank distal from said shank first end, and said rake adjustment member adjusting the angle of said longitudinal axis of said hammer tool body in relation to said shank;

a rake measurement scale attached to said hammer tool body capable of measuring said angular adjustment of said longitudinal axis of said hammer tool body in relation to said shank;

an extender having a first end and a second end, said extender first end slidably attached to said hammer tool body second end;

an extender shoe attached perpendicularly to said extender second end;

a shank extension slidably attached to said shank second end, and said shank extension having an aperture sized to fit about said hammer shank.

* * * * *